United States Patent [19]

Kobayashi et al.

[11] Patent Number: 4,811,897

[45] Date of Patent: Mar. 14, 1989

[54] DUCT TYPE AIR CONDITIONING SYSTEM

[75] Inventors: Toyohiro Kobayashi, Shizuoka; Nobuo Otsuka, Kamakura, both of Japan; Peter Thompson, Cypress, Calif.

[73] Assignee: Mitsubishi Denki Kabushiki Kaisha, Tokyo, Japan

[21] Appl. No.: 16,823

[22] Filed: Feb. 20, 1987

[30] Foreign Application Priority Data

Feb. 20, 1986 [JP] Japan ..... 61-35501
Feb. 20, 1986 [JP] Japan ..... 61-37775

[51] Int. Cl.[4] ..... F24F 7/00

[52] U.S. Cl. ..... 236/49; 236/51; 165/22; 340/310 A; 340/825.07

[58] Field of Search ..... 236/49, 1 B, 51; 165/22; 340/825.06, 825.07, 825.08, 310 R, 310 A, 310 CP

[56] References Cited

U.S. PATENT DOCUMENTS

| | | | |
|---|---|---|---|
| 3,716,096 | 2/1973 | Berrett et al. | 340/825.06 X |
| 4,362,270 | 12/1982 | Cleary et al. | 236/51 X |
| 4,479,604 | 10/1984 | Didner | 236/49 D |
| 4,646,962 | 3/1987 | Grant | 236/49 D |
| 4,682,648 | 7/1987 | Fried | 236/51 |

*Primary Examiner*—Harry B. Tanner
*Attorney, Agent, or Firm*—Sughrue, Mion, Zinn, Macpeak and Seas

[57] ABSTRACT

An air conditioning system provided with a variable capability blower and heat source unit is configured such that individual room dampers 9 and controllers 14 can be subsequently added to a central control device as options to convert from an all room simultaneous air conditioning mode to a variable air volume mode with separate temperature control for each room. The utilization of existing power lines to transmit the various information and control signals simplifies the conversion and reduces its cost.

6 Claims, 8 Drawing Sheets

FIG. 1 PRIOR ART
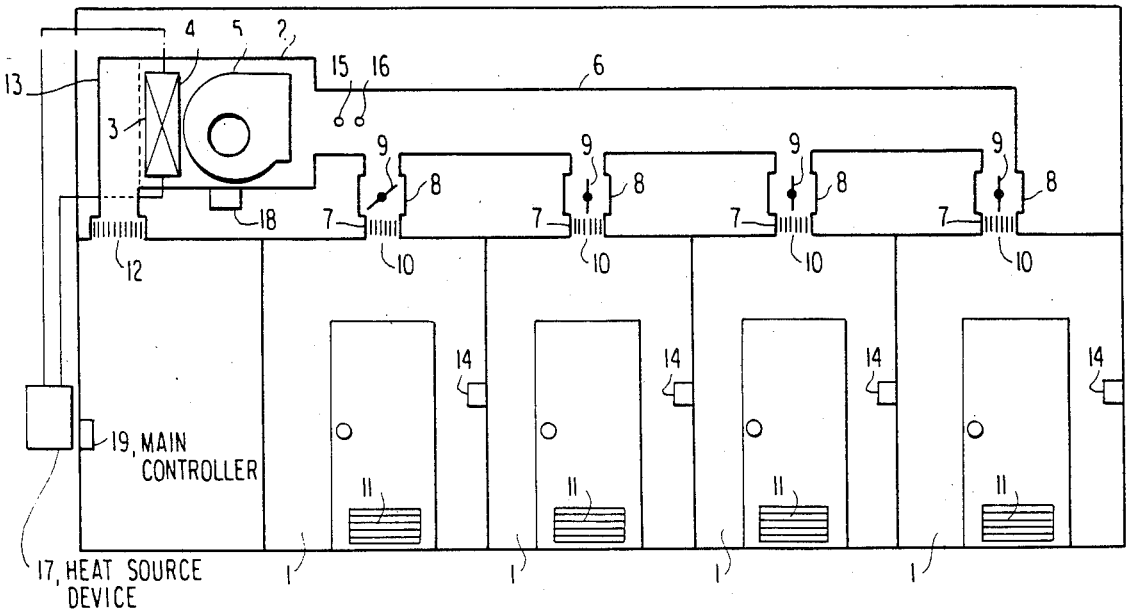
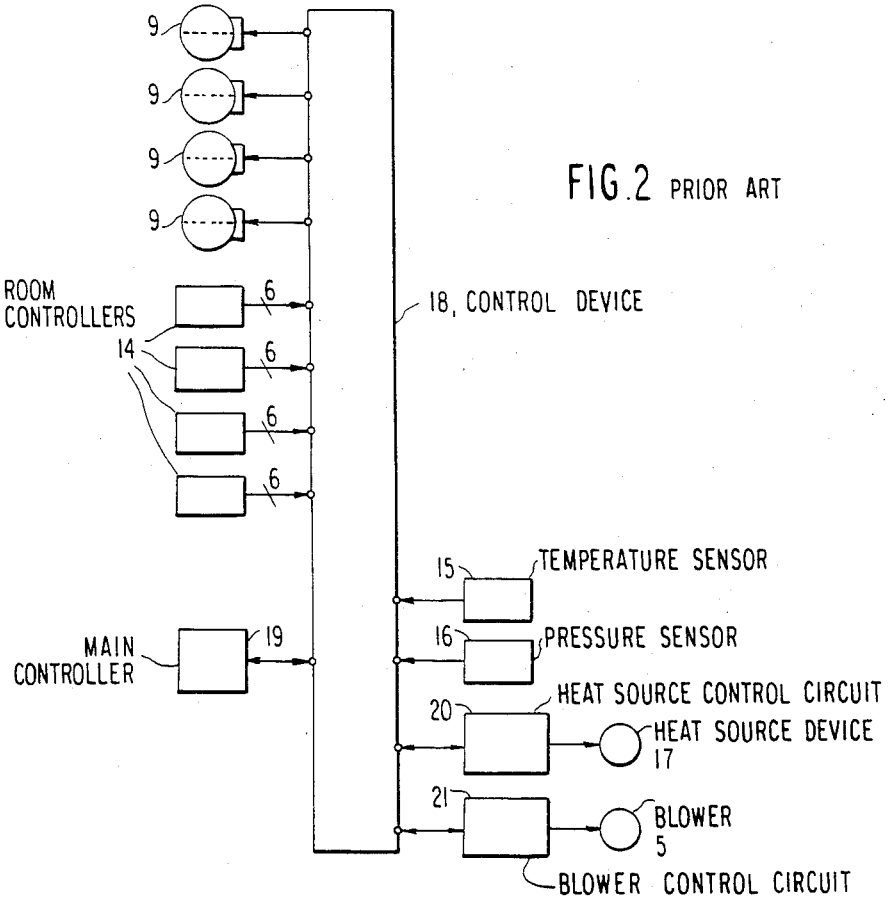
FIG. 2 PRIOR ART 4
2
6
5
16
3
4A
12
105
101
101A
104
104A
9A
9
9B
17A
17
17C
17B
17D
106
72 °F
102
103
14A
14

START BITS
SELF ADDRESS
OPPONENT ADDRESS
DATA BITS
ST
SAD1
SAD2
PAD1
PAD2
DT1
DT2
DTN
SP

INDOOR UNIT TRANSMISSION
RECEPTION
OUTPUT UNIT TRANSMISSION
RECEPTION
VAV CONTROL UNIT TRANSMISSION
RECEPTION
ST
SAD
PAD
DT
SP1
SP2
SP3
SP4
SP5
VAV CONTROL UNIT CONNECTION

DUCT TYPE AIR CONDITIONING SYSTEM

BACKGROUND OF THE INVENTION

1. Field of the Invention

This invention relates to a duct type air conditioning system which employs a variable air volume (VAV) control capable of independently adjusting the temperature of each room.

2. Description of the Prior Art

Central air conditioning systems which distribute temperature adjusted air to each room via an air duct are widely employed in office buildings and the like because of their many advantages as compared with heat pump chiller-fan coil systems, decentralized packaged air conditioner systems, etc. A ducted central air conditioning system is capable of providing conditioned air with high quality since it may easily incorporate a humidifier and a high performance filter, and adapt to external or outdoor air ventilation and full heat exchange, and since each room which is to be air conditioned is provided with only a supply opening and a suction opening the room space can be used more effectively. Among the various types of central air conditioning systems, a variable air volume (VAV) control type which can be operated with saved energy is capable of controlling the temperature of each room having a different heating load independently, and it is also possible to stop the air conditioning of a room which is not used. Moreover, the operating cost can be reduced by varying the blower power depending on the required quantity of air, and it is also possible to minimize the size of the heat source taking the duty rate thereof into consideration.

There are several types of VAV systems. One is a throttle type unit in which the pressure within a duct, which changes depending on the degree of opening of a damper, is detected, and the blower capacity is controlled so that the detected pressure remains at a set value. When the load is decreased (even when the volume of blown air is decreased, the air temperature within the duct is controlled to be constant), the required capacity of the heat source is reduced, and at the same time the blower power is decreased.

Prior art VAV throttle type units are disclosed in Japanese Patent Publication No. 60-47497, and in FIG. 2.10(*a*) of the Refrigeration and Air Conditioning Handbook issued by the Japanese Association of Refrigeration.

FIG. 1 is a schematic diagram of an air conditioning system described in the above Handbook, wherein reference numeral 1 designates each of the four rooms to be air conditioned, reference numeral 2 designates an indoor unit disposed within the ceiling space of the building and composed of an air filter 3, a heat exchanger 4, and a blower 5, reference numeral 6 designates a main duct connected to an air supply opening of the indoor unit, 7 designates the four branch ducts for the rooms, 8 designates a VAV throttle unit inserted in a mid-portion of each branch duct, 9 designates a rotatable damper, 10 designates a supply opening provided in the end of each branch duct, 11 designates a suction opening provided at the bottom of each room door, 12 designates a suction opening provided in the ceiling of a corridor, 13 designates a duct connecting the ceiling opening 12 to the suction return of the unit 2, 14 designates room controllers (thermostats) each including a temperature sensor, 15 designates a temperature sensor disposed within the main duct 6, 16 designates a pressure sensor also disposed within the main duct, 17 designates a heat source device such as a heat pump or the like connected to the heat exchanger 4, 18 designates a control device for operating and controlling the heat source device, the blower 5, and the dampers 9, and 19 designates a main controller serving as an operating board to change over among modes including cooling, heating, stop, etc., and to set a program for room temperature.

In such a prior art air conditioning system, the degree of opening of each damper 9 is adjusted to a desired position in accordance with the difference between a temperature set by each room controller 14 and the sensed actual air temperature. Depending on the degree of opening of the dampers 9, the pressure within the main duct 6 is changed. This change is detected by the pressure sensor 16, and the capacity or output of the blower 5 is regulated o that a preset pressure is maintained. Further, since the outlet air temperature of the heat exchanger 4 is changed following a change in the volume of blown air, this temperature is detected by the temperature sensor 15, and the output of the heat source device 17 is controlled so that a preset air temperature is maintained. In this manner the air whose temperature is regulated to substantially a fixed degree is blown out from the supply openings 10 into the rooms 1 with a volume or at a rate corresponding to the magnitude of the heating load in each room. The conditioning supply air is returned through the suction openings 11 and the ceiling opening 12 to the indoor unit 2 via the suction duct 13 for recirculation.

The various control functions re carried out by the device 18 to achieve an optimum operation which satisfies energy saving and comfort conditions based on input signals from the main controller 19, the room controllers 14, temperature sensor 15, pressure sensor 16, and various other sensors (not shown) in the heat source device 17.

The control device 18 as shown in FIG. 2 includes, for example, a microprocessor, and its inputs/outputs are connected to each of the room controllers 14 by an I/O driver or the like. To each room controller 14, there are connected power supply lines and a plurality of signal transmission lines from the control device 18. Since there are four room controllers in the example shown, when two power supply lines and four signal transmission lines are needed for each room, installation work for a total of twenty-four lines (6 lines×4 rooms) is required for wiring and distribution to each of the rooms. Reference numeral 20 designates a heat source control circuit, and 21 designates a blower control circuit.

In such a prior art VAV system, the degree of opening of the dampers 9 is controlled based on the signals of the room controllers 14, and the temperature in each room is controlled accurately. At the same time, energy and cost are saved by closing the damper 9 of the first room 1 which is empty, and air conditioning is performed only for the rooms where it is required. In general, VAV air conditioning equipment for use in houses has not been widely accepted because of its high initial equipment and installation cost, even though its operating cost is comparatively low.

SUMMARY OF THE INVENTION

The present invention enables the inexpensive modification of a duct type air conditioning system using initially installed central and lump air conditioning equipment, to obtain a VAV type of control system with its attendant low operating cost, whereby users may adopt a VAV system at a later day by purchasing and adding VAV control components.

In the present invention, a room controller for each room and a VAV control unit are added to a central air conditioning system which has been purchased and installed beforehand, to thus modify the system to function in a VAV mode. Actual and set room temperatures for each room obtained from the room controllers together with information on a room(s) to be regulated are transmitted to the VAV control unit, which then controls the opening of the dampers in each room individually based on these inputs, and at the same time, transmits load information for each room to an indoor control device together with static pressure information within the duct. By this arrangement VAV control is performed for each room individually in correspondence to the set temperature, and when the VAV control signal is not present the indoor control device is changed over to a simultaneous and lump air conditioning control thereby enabling both simultaneous and lump air conditioning and VAV control.

BRIEF DESCRIPTION OF THE DRAWINGS

FIG. 1 is a schematic diagram showing an overall system structure of a prior art air conditioning system;

FIG. 2 is a block diagram showing a prior art control section;

DETAILED DESCRIPTION OF THE PREFERRED EMBODIMENTS

Figure 3:
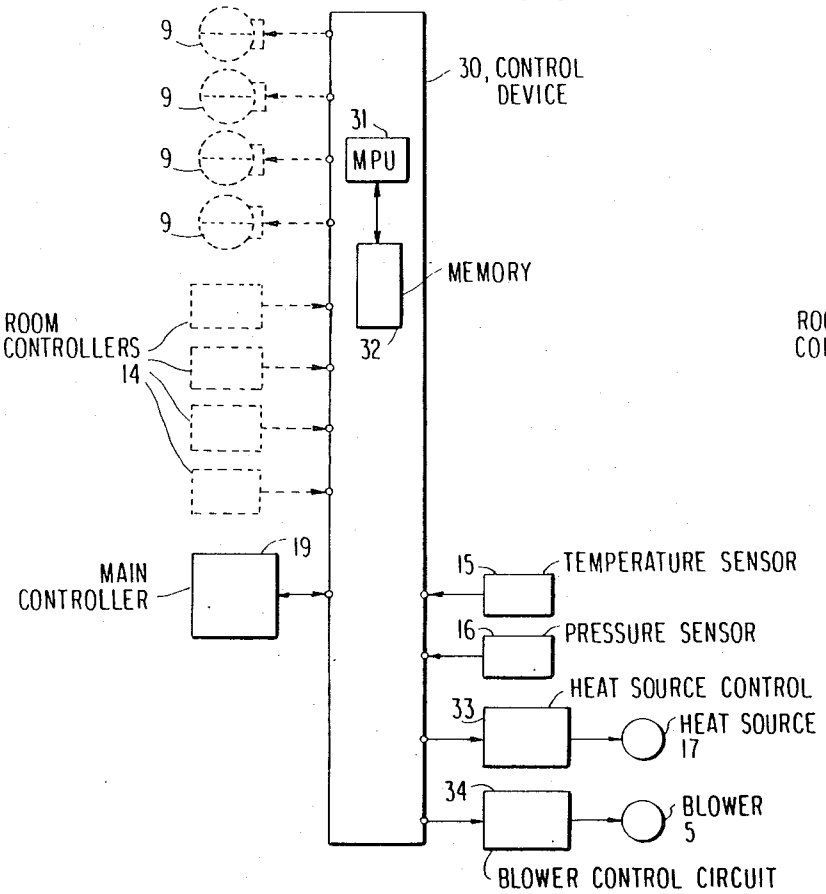

In FIG. 3 reference numeral 30 designates a control device which operates a variable capacity duct type air conditioning system, including a microprocessor 31, and a memory 32 which stores a control algorithm required for all rooms for simultaneous air conditioning and a control algorithm for a VAV control, and which further includes an input/output terminal board for connecting various external equipment such as dampers 9, room controllers 14, etc., which are user's options, and relays (not shown) for controlling the outputs to these external equipments.

The algorithm to be used is determined by automatically detecting whether or not a room controller(s) 14 which will be described later is connected to the control device 30, or by the position of a switch (not shown) set at the time of installing the system.

A main controller 19 performs, similar to the prior art, changeovers among modes including cooling, heating, stop, etc., and program settings for the room temperatures, and the like, and is connected to the control device 30 so that specifications are met in which it can be used for both all room simultaneous air conditioning and VAV control in common.

A sensor 15 for detecting the air temperature in the main duct 6 and a sensor 16 for detecting the fan pressure in the main duct are also connected to the control device 30.

Reference numeral 33 designates a control circuit connected to the device 30 and having an output connected to a heat source device 17. When the latter comprises a heat pump or an air conditioner, an inverter is used in the circuit 33 to variably control the output frequency thereof and to control the capability of the heat pump or the like by varying the rotational speed of a compressor supplied with the variable frequency. When the heat source device is a gas furnace, a capability control system is used in which the gas flow rate is varied by a proportional valve.

Reference numeral 34 designates a blower capacity control circuit which comprises a phase control device using a thyristor, or a variable frequency inverter, and its output is connected to a blower 5.

In FIG. 3, a plurality of dampers 9 and room controllers 14 shown by broken lines are assembled as user's options in respective branched ducts 7 (refer to FIG. 2) and in respective rooms 1 when the duct type air conditioning equipment for all room simultaneous air conditioning is to be modified to a VAV type, and these dampers and room controllers are connected to the control device 30 through an input/output terminal board (not shown). Each of the dampers 9 is provided with a stepping motor for opening and closing operation.

In the air conditioning equipment arranged as described above, when it is used as an all room simultaneous air conditioner the dampers 9 and room controllers 14 are effectively disconnected. In this case the control device 30 operates according to the control algorithm required to perform all room simultaneous air conditioning, and it controls the heat source device 17 and the blower 5 based on the room temperature program of the main controller 19 and detection signals from the temperature sensor 15 and the pressure sensor 16. Consequently, the temperature of all rooms is simultaneously controlled to attain a temperature set by the main controller 19.

On the other hand, when the equipment or system is operated in a VAV mode, the outputs to and from the dampers 9 and room controllers 14 are operatively connected to the control device 30, which is then changed over to the control algorithm for the VAV mode such that each room temperature is individually controlled.

In this respect, in either of the air conditioning modes mentioned above, the air pressure and temperature within the main duct 6 are respectively detected by the pressure and temperature sensors 16, 15, and the heat source device 17 and blower 5 are controlled by the circuits 33 and 34 so that the detected set values remain constant. As a result, stable operation is realized wherein the on and off times of the heat source device are reduced.

Figure 4:
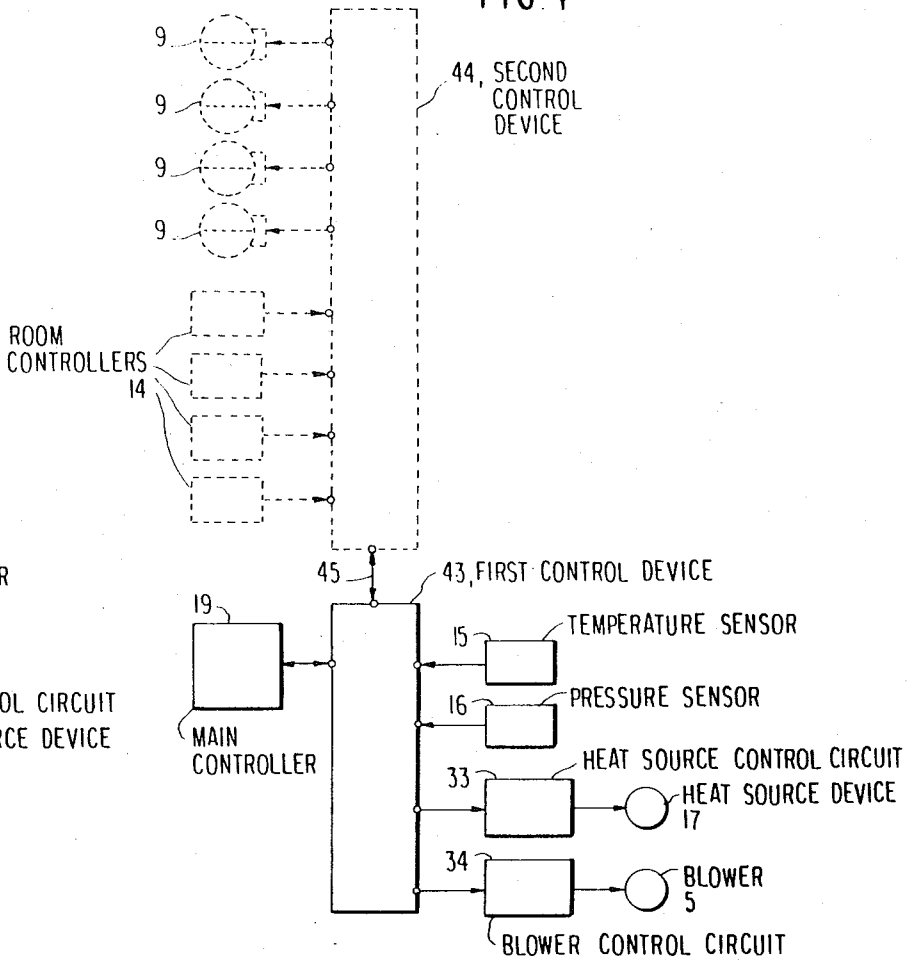
FIGS. 3 and 4 are respectively block diagrams showing control sections in accordance with embodiments of the present invention.

FIG. 4 shows another embodiment of the invention, wherein the control device 30 in FIG. 3 is divided into a first control device 43 and a second control device 44. Only the main controller 19, temperature sensor 15, pressure sensor 16, heat source capability control circuit 33, and blower capacity control circuit 34 required for all room simultaneous air conditioning are connected to the first control device 43, and only the dampers 9 and room controllers 14 are connected to the second control device 44. The broken line elements thus constitute an option package which is installed only when a VAV mode is specified, the first and second control devices 43, 44 then being joined by a connector 45 so that the transmission and reception of the signals can be effected. The second control device 44 is also provided with a microcomputer for storing a control algorithm(s) for the dampers 9 and room controllers 14, an input-/output terminal board, and relays (not shown).

This embodiment provides the same effects as that of FIG. 3, but the price of the equipment when sold as an all room simultaneous air conditioning system is reduced. As a further alternative, the control algorithm storage may be provided in the first control device 43, and only the terminal board and the relays provided in the second control device 44. The price can thus be reduced by the amount of the microcomputer which is not included.

Figure 5:
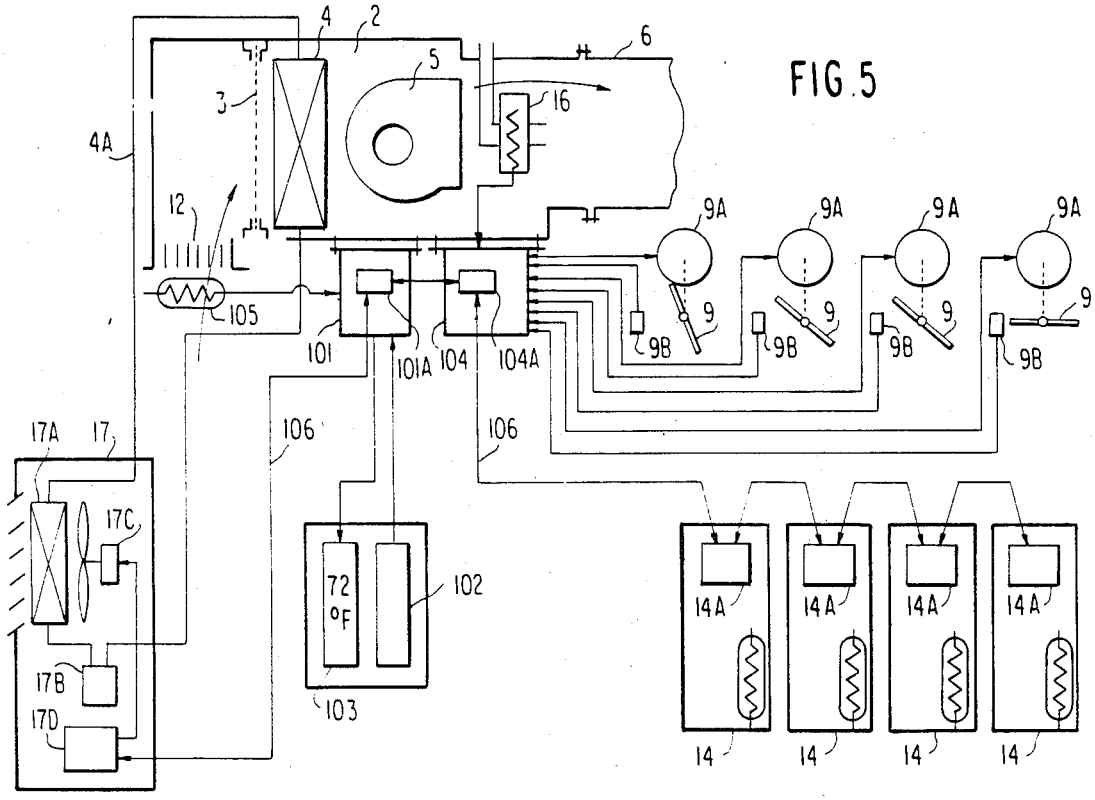
FIG. 5 is a schematic diagram illustrating the overall system structure of main portions of a duct type air conditioning system in accordance with the invention.
Figure 6:
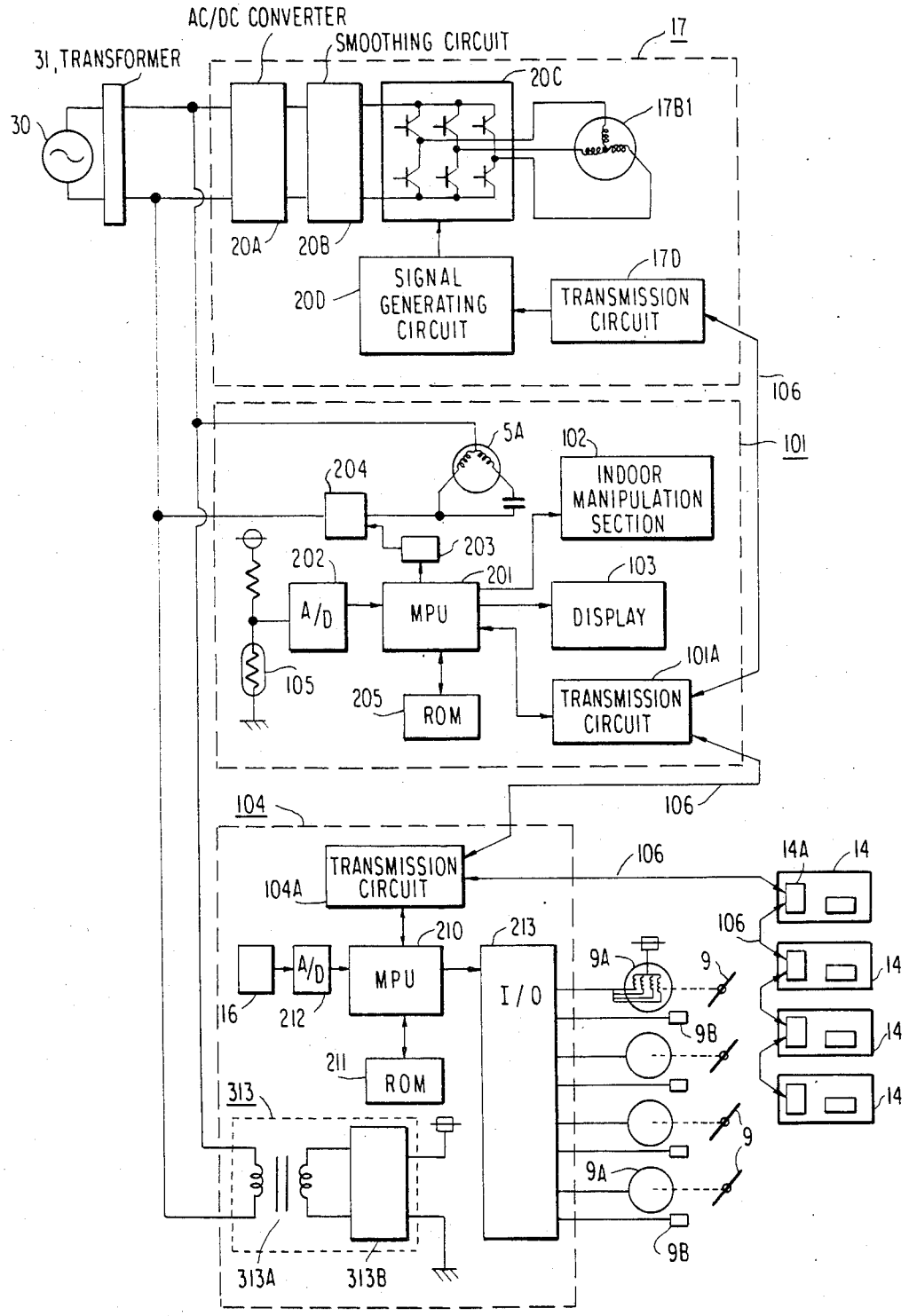
FIG. 6 is a circuit diagram showing an example of a communication control in the invention.

In the embodiment of FIG. 5, a heat source device 17 (constituted by an inverter type compressor whose capacity can be controlled, hereinafter referred to as an outdoor machine) installed outside of the rooms includes an outdoor heat exchanger 17A connected to an indoor heat exchanger 4 through coolant piping 4A, a compressor 17B, and a blower 17C. An indoor control device 101 receives signals from an air temperature sensor 105 provided near a suction opening 12 of an air circulation path, and from an indoor manipulation section 102 (corresponding to the main controller 19 in FIG. 1) for setting room temperature and the like, and a suction air temperature display signal is outputted from the control device 101 to a temperature display 103. At the same time, an air flow speed control command is issued to an indoor fan motor 5A (FIG. 6). As a result, the indoor control device 101 functions to perform whole building simultaneous and lump air conditioning (hereinafter referred to as central and lump air conditioning) on the basis of the suction air temperature data and the input data from the indoor manipulation section 102.

The indoor control device 101 may also implement a zone or VAV control, by automatically receiving required information from a VAV control unit 104 which may be additionally installed or mounted as an option later. For this purpose, the indoor control device 101 and the VAV control unit 104 respectively include serial transmission circuits 101A and 104A to send and receive information for the VAV control. These circuits are connected by a transmission line 106 of a frequency multiplex DC power transmission type formed with two wires. The serial transmission circuit 101A is connected to a serial transmission circuit 17D of a similar type provided in the outdoor machine 17 via a further two wire transmission line 106. The VAV control unit 104 is also connected through transmission lines 106 with serial transmission circuits 14A provided in each room controller 14, designed to transmit temperature information of each room.

The VAV control unit 104 receives a detection signal from the pressure sensor 16 for measuring static pressure mounted within the discharge air duct 6, and position signals from sensors 9B representing the rotational angles of the dampers 9, and the VAV control unit 104 outputs control signals to damper motors 9A to control the openings of the respective dampers depending on the fan pressure and room temperature.

FIG. 6 shows the internal circuits of the indoor control device 101, VAV control unit 104, and outdoor machine 17, which enable the transmission of the information required for the VAV control described above. In this FIG., the outdoor machine 17 is connected to an AC power supply 30 through a transformer 31, and comprises an AC/DC converter 20A, a smoothing circuit 20B for smoothing the DC output, an inverter 20C for converting the DC output to three-phase AC at a desired frequency, a three-phase AC motor 17B1 for a compressor driven by the AC output from the inverter 20C, and a signal generating section 20D for generating a PWM (pulse width modulation) signal for controlling the conduction of the inverter 20C consisting of a power transistor by converting and processing the information transmitted from the serial transmission circuit 17D into an analog signal.

The indoor control device 101 includes a microprocessor (MPU) 201 connected to the indoor manipulation section 102 and the air temperature display 103, and an A/D converter section 202 for converting the detection signal of the suction air temperature sensor 105 into a digital quantity is also connected to the microprocessor. In addition, the microprocessor 201 operates an output driver 203 by applying thereto an output signal calculated in correspondence to the suction air temperature, which in turn controls a driving motor 5A of the blower 5 through a phase control element 204 such as a TRIAC connected to the power supply circuit of the motor. The driving motor speed is thus controlled corresponding to the suction air temperature to control the discharge air volume of the blower 5. The air volume control program is stored in a memory (ROM) 205 connected to the microprocessor. The memory 205 also stores a processing program for judging in the microprocessor 201 whether central and lump air conditioning is to be performed, or if the information required for VAV control is to be transmitted from the VAV control unit 104 through the serial transmission circuit 101A.

The VAV control unit 104 includes a microprocessor (MPU) 210, a memory (ROM) 211, an A/D converter 212 for converting the detection signal of the pressure sensor 16 to a digital quantity, an input/output circuit (I/O) 213 for sending control signals to the damper motors 9A and for receiving signals from the position sensors 9B, and a serial transmission circuit 104A. The memory 211 stores a zone control program which effects the air conditioning of each room individually through each duct. Reference numeral 313 designates a power supply circuit for each damper motor 9A, comprising a transformer 313A connected to the AC power supply 30, 31, and a rectifier circuit 313B connected to the transformer secondary.

Figure 7:
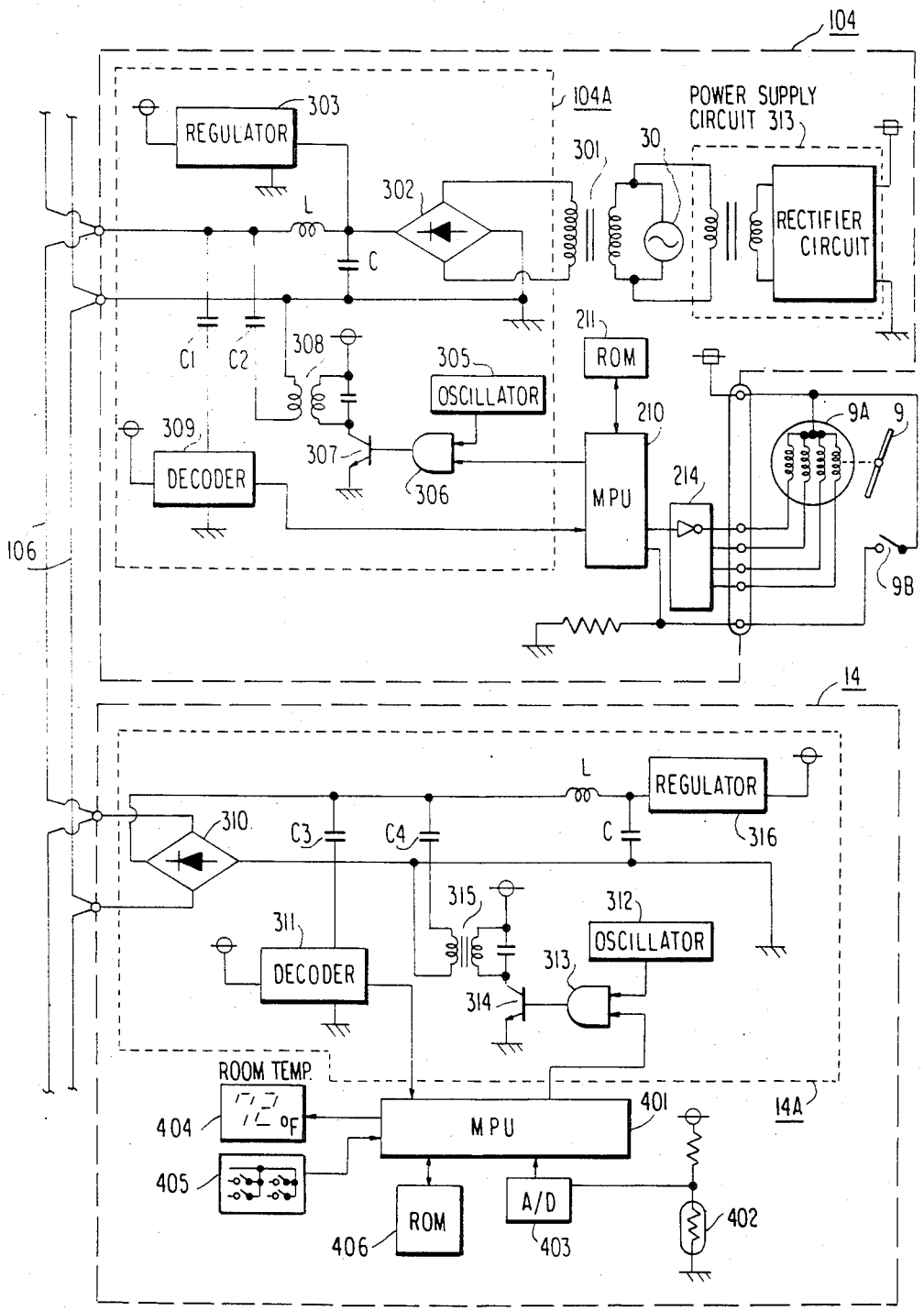
FIG. 7 is a circuit diagram showing an example of a communication system of a VAV control section and a room controller in the invention.

FIG. 7 shows the serial transmission circuits 104A and 14A for communication between the VAV control unit 104 and the room controllers 14. The circuit 104A includes a rectifier 302 connected to the AC power supply 30 through a voltage divider transformer 301 to generate a DC voltage of 12 V, the DC output terminal of the rectifier being connected to the transmission line 106 through an L-C smoothing circuit. Reference numeral 303 designates a three-terminal regulator connected to the DC output terminal of the rectifier 302 for supplying DC power to the microprocessor 210, etc. Reference numeral 309 designates a tone decoder connected to the power supply line of the rectifier 302 through a coupling capacitor C1 for detecting a high frequency carrier signal superposed on the 12 V DC; it discriminates the information signal and converts it into a serial pulse signal supplied to the microprocessor 210. This circuit serves as a receiver in the serial transmission circuit 104A.

The transmitting system includes an AND gate 306 having one input receiving a transmitting pulse signal from the microprocessor 210 and the other input receiving a carrier signal from an oscillator 305 for mixing the two signals, a transistor 307 controlled by the output of the AND gate, and a pulse coupling transformer 308 having a primary connected to the transistor collector and a secondary connected to the power supply line of the rectifier 302 through a coupling capacitor C2. Reference numeral 214 designates a driving circuit for driving and controlling the damper motor(s) 9A.

The room controller 14 includes a diode bridge 310 which constitutes a DC power supply of 12 V, and which also functions to regulate the high frequency signal superposed on the 12 V DC. A tone decoder 311 constituting the receiving system is connected to an output line of the bridge through a coupling capacitor C3. The tone decoder 311 detects the high frequency carrier signal superposed on the DC, and decodes only the information signal and converts it into a serial pulse signal inputted to a microprocessor 401. The transmitting system of the room controller 14 includes an AND gate 313 having one input receiving a pulse signal from the microprocessor 401 and the other input receiving a carrier signal from an oscillator 312 for mixing the two signals, a transistor 314 controlled by the output of the AND gate, and a pulse coupling transformer 315 having a primary connected to the transistor collector and a secondary connected to an output of the diode bridge through a coupling capacitor C4. Reference numeral 316 designates a three-terminal regulator connected to the output of the bridge through an L-C smoothing circuit; it serves as a DC power source for the microprocessor 401, etc.

An A/D converter 403 for converting the air temperature detection signal of a thermistor 402 into a digital quantity, a display 404 for displaying the room temperature, and a manipulation section 405 for setting the room temperature and the like are connected to the microprocessor 401, together with a memory 406 (ROM) for storing a processing program.

The serial transmission circuits of the indoor control device 101 and the outdoor machine 17 are constituted similar to the transmission circuits of the room controllers 14.

Figure 8A:
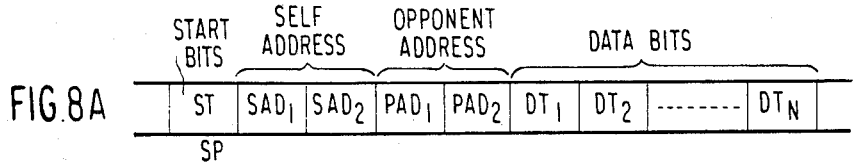
FIGS. 8A and 8B are diagrams showing protocol for a serial communication in the invention.
Figure 8B:
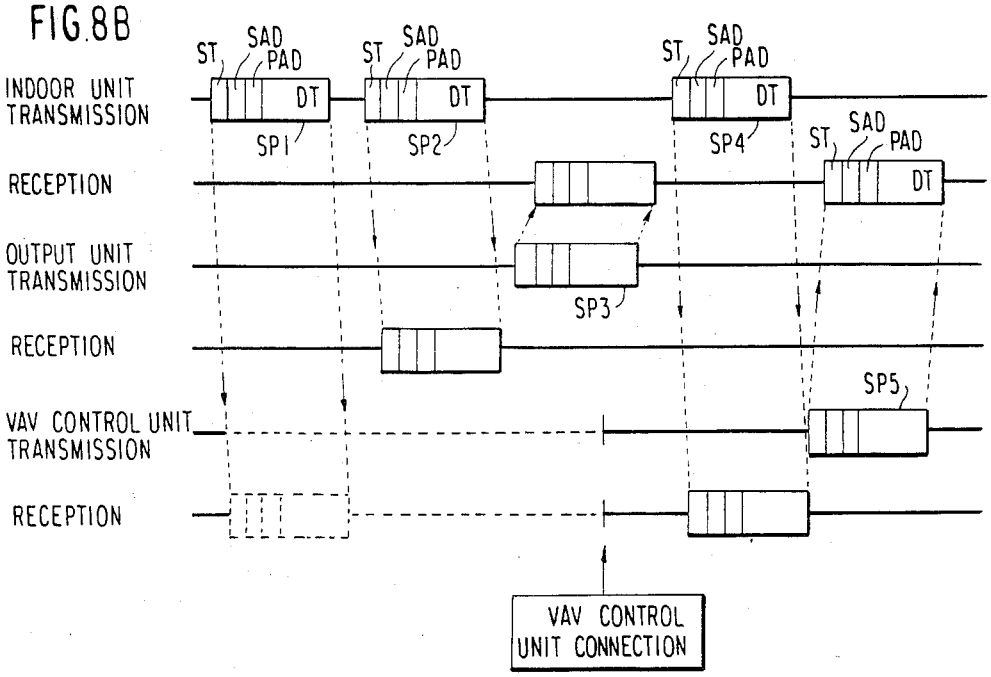

FIG. 8A shows an example of a serial transmission signal format formed by start bits ST, self address bits $SAD_1$, $SAD_2$, and opponent address bits $PAD_1$, $PAD_2$ for identifying a group of room controllers 14, and data bits $DT_1$–DTn. FIG. 8B shows an example of communications among the indoor control device 101, outdoor machine 17, and VAV control unit 104.

Figure 9:
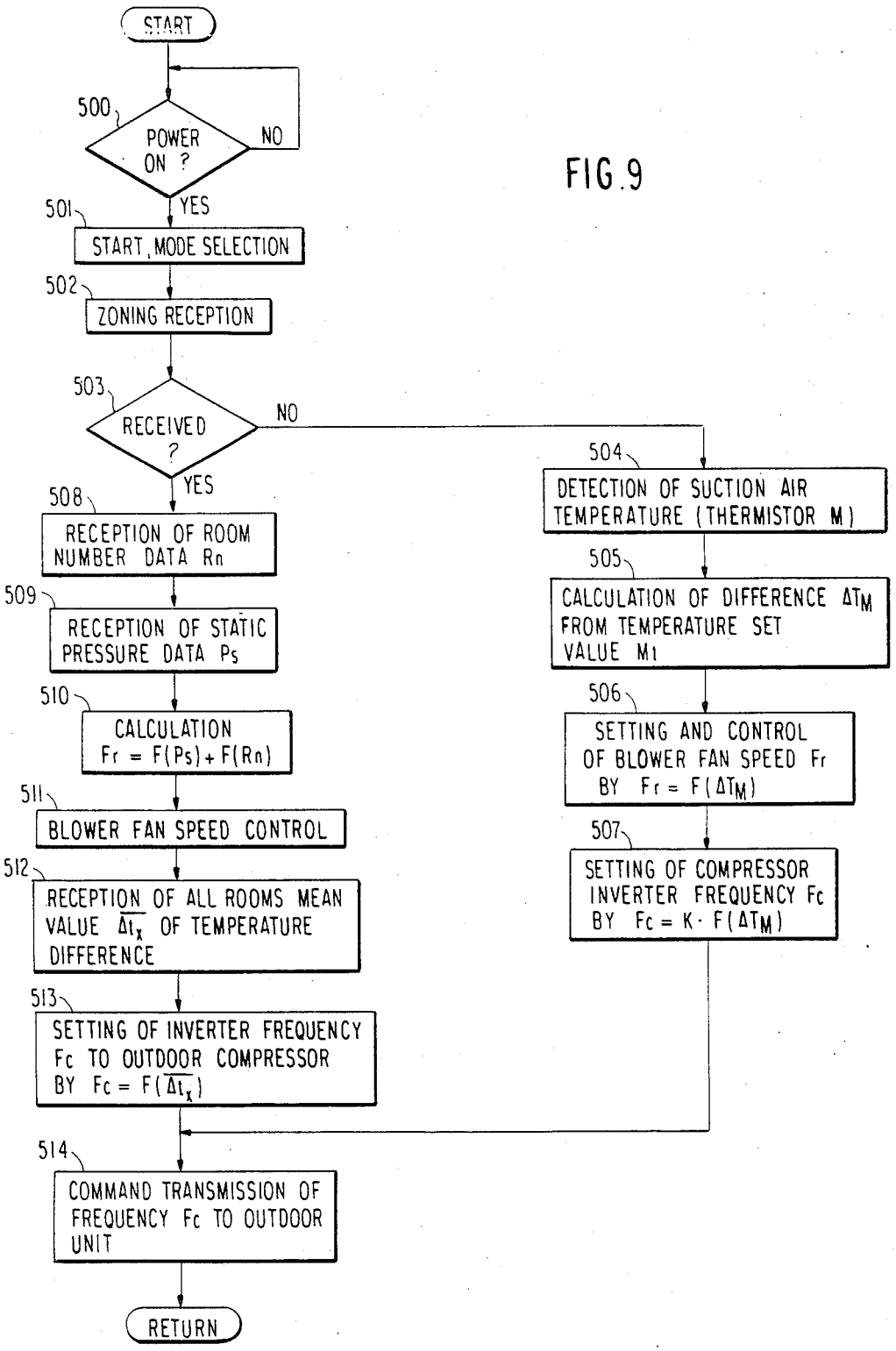
FIGS. 9, 10 and 11 are flowcharts for explaining the operation of the invention.
Figure 10:
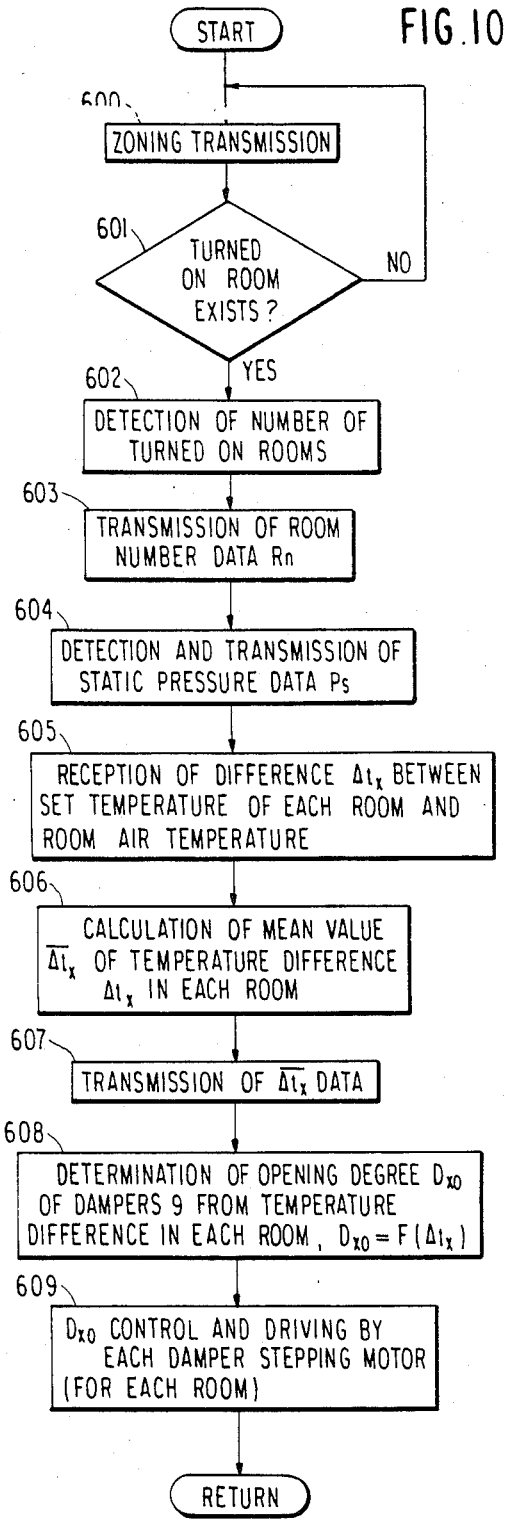

The operation of the embodiments described above will now be described with reference to FIGS. 9–11, beginning with the operation of the indoor control device 101 which will be described according to a processing procedure shown in the flowchart of FIG. 9.

By the initialization of the control device 101 the program is started, and in step 500 it is decided whether or not the power supply for the air conditioning equipment is turned on. When the power on condition is decided, in the next step 501, such condition is displayed and at the same time mode selection processing is carried out to select one of the modes including cooling, heating, etc., of the indoor machine 2 and the outdoor machine 17 in accordance with a command of the indoor manipulation section 102, and start processing of the air conditioning equipment is carried out following the mode selection. The program then proceeds to step 502, whereat zone reception processing is executed and the outdoor machine 17 and the VAV control unit 104 are enabled to perform communication.

In other words, firstly, it is decided whether the VAV control unit 104 is mounted on the air conditioning equipment as shown in FIG. 5. FIG. 8B shows an example of the case in which this decision is executed by polling processing. A code designating the VAV control unit is set in the opponent address bits $PAD_1$ and $PAD_2$ of a transmitting signal packet SP, and transmitted data including this discriminating information is sent out through the serial transmission circuit 101A and the transmission line or bus 106. In this case, if the VAV control unit 104 is not mounted, since the answer back from the VAV control unit 104 in response to the transmitted data SP1 is not received even after a fixed time elapses, it is decided that zoning is not selected (step 503), and the program proceeds to a mode of central and lump air conditioning. Steps 504 –507 show the processing procedure for such a mode.

In the indoor control device 101, as shown in step 504, the suction air temperature detected by the sensor 105 is inputted to the microprocessor 201 through the A/D converter 202, and in the next step 505, a difference $\Delta T_M$ between the temperature value Mt set by the manipulation section 102 and the detected temperature is calculated. In the next step 506, a calculation of $Fr=F(\Delta T_M)$ is executed and the speed Fr of the blower 5 is set. In L the next step 507, by calculating an equation $Fc=K\cdot F(\Delta T_M)$, the capacity of the compressor 17B, that is, the frequency Fc of the inverter output supplied to the compressor driving motor 17B1, is set.

The speed data Fr calculated in step 506 is outputted from the microprocessor 201 to the output driver 203, and by controlling the conduction angle of the control element 204 the air volume from the blower 5 is controlled in accordance with the difference between the suction air temperature and the set temperature. Further, the set frequency data for the capacity control of the compressor set in step 507 is processed in step 514 to send to the outdoor machine 17.

Specifically, in the indoor control device 101, a code designating the outdoor machine 17 is set in the opponent address bits, and the transmission data SP2 is sent out to the outdoor machine 17 through the serial transmission circuit 101A and the transmission line. In the outdoor machine 17, its serial transmission circuit 17D receives the transmitted data SP2, and when it is determined that the data is its own, the circuit 17D sends data SP3 including answer back and other data to the indoor control device 101 as shown in FIG. 8B. The frequency data Fc which is set in data bits in the transmitted data SP2 is decoded and applied to the signal generating circuit 20D, and by applying the PWM signal generated by circuit 20D to each transistor of the inverter 20C, the AC output frequency supplied to the AC motor 17B1 is controlled to thereby suitably control the capacity of the compressor 17B for lump air conditioning.

On the other hand, if the VAV control unit 104 is installed and a transmission line is connected to it, as shown in FIG. 8B transmitted data SP4 including a discriminating code of the VAV control unit 104 is sent out and this data is received by the serial transmission circuit 104A of the VAV control unit. If it is decided that the transmitted data is its own, then the serial transmission circuit 104A transmits data SP5 including answer back and other information (VAV control information) to the indoor control device 101 as shown in FIG. 8B, and the VAV control unit 104 and the indoor control device 101 are enabled to communicate to each other.

More specifically, when zoning is selected, and if it is decided in step 503 that both are able to communicate with each other, the program proceeds to step 508 and the processing of received room number data Rn from the VAV control unit 104 is executed. The received data at this time includes not only the room numbers, but other information as to the size of each room and its load condition (facing south, or with kitchen, etc.). The setting of the load condition information is carried out in the manipulating section 405 (bit switch) in each room controller 14.

When the receiving processing of the room number Rn is finished, the program proceeds to the next step 509, and processing for receiving static pressure data Ps (detection signal of pressure sensor 16) from the VAV control unit 104 is executed. In the next step 510, the calculation of an equation $Fr=F(Ps)+F(Rn)$ is carried out based on the received data Rn and Ps, and the rotational speed Fr of the blower 5 is calculated to supply the necessary air volume to the main duct 6. When the rotational speed data obtained in this calculation is applied to the driver 203, it is converted to a phase control signal for the control element 204, and by triggering the gate of the control element with this signal the supply voltage to the blower motor 5A from the power source 30 is controlled to thereby change the rotational speed of the motor 5A, and the blown air volume is thus controlled according to the value calculated (Fr) in step 511. From the standpoint of achieving a capacity control useful to energy saving, it will be optimum if a DC motor or an inverter control type motor is utilized.

Next, in step 512, a mean value $\Delta t_x$ of the temperature difference in each room is received from the VAV control unit 104. When this receiving processing is finished, the program proceeds to step 513 whereat the overall heating load is calculated from the mean value $\Delta t_x$ and a capacity control value (Fc) for the outdoor machine heat source is set. In other words, by calculating $Fc=F(\Delta t_x)$, the output frequency value Fc of the inverter 20C which is supplied to the motor 17B1 of the outdoor compressor 17B is set. In the next step 514, communication between the serial transmission circuits 101A of the indoor control device 101 and 17D of the outdoor machine 17 is established, and the set command data specifying Fc is sent to the outdoor machine whereat the received value of Fc is decoded in a microcomputer (not shown) within the serial transmission circuit 17D, and is then applied to the signal generating circuit 20D. By applying a PWM signal generated therefrom to each transistor of the inverter 20C, the AC output frequency supplied to the motor 17B1 is controlled to thereby control the capacity of the compressor 17.

In the embodiments mentioned above, although it is described that the capacity control value Fc of the outdoor machine heat source is a frequency signal, instead of this a burner capacity control value of a gas furnace may be used.

Next, the operation of the VAV control unit 104 will be described based on the flowchart of FIG. 10 which shows a control procedure for zoning, that is, for the data transmission to the indoor control device 101 for VAV control, and for zoning in which each room is air conditioned individually. When the program is started by the initialization of the VAV control unit 104, in step 600 the communication for zoning transmission from the VAV control unit 104 to the indoor control device 101 is established by the polling method of FIG. 8B described above. In this respect, the establishment of the data link in which the VAV control unit 104 is selected and connected to the indoor control device 101 for zoning is effected by transmitting address data of the VAV control unit itself allocated in the self address bits in the serial signal train of FIG. 8A.

After the zoning transmission has been established, in step 601, it is decided whether there is a room which is turned on. In other words, it is decided by polling between the VAV control unit 104 and each room controller 14 by utilizing, for example, the opponent address bits in the serial signal data shown in FIG. 8A, from which of the controllers 14 of the four rooms the signal is received, or which room has requested air conditioning.

On the basis of the information transmitted from each room controller 14, the number of rooms which are selected is detected (step 602), and then in step 603, detected room number data Rn is sent to the indoor control device 101. Thereafter, in step 604, the fan pressure within the duct 6 detected by the pressure sensor 16 is processed by the microprocessor 210 to calculate static pressure data Ps, and this data is sent to the indoor control device 101 through the serial transmission circuits 104A and 101A. In the next step 605, the differences $\Delta t_x$ between the set temperatures of each room sent from each room controller and the actual room air temperatures are received. In step 606 an integrated mean value $\Delta t_x$ of the temperature difference $\Delta t_x$ of each room is calculated. After this $\Delta t_x$ data is transformed into a serial signal train as shown in FIG. 8A, it is sent to the indoor control device 101 through the transmission circuit (step 607).

Step 608 is a processing program to determine the degree of opening $D_{xo}$ of the dampers 9 by calculating a formula $D_{xo}=F(\Delta t_x)$ from the difference $\Delta t_x$ between the set temperature of each room and the actual room temperature, or by map designation by making reference to a table. In the next step 609, a stepping pulse number is calculated based on the determined opening degree data $D_{xo}$, and by applying this pulse signal through the driver 214 to the damper motor 9A, for example a stepping motor, the motor is driven and the angle of the damper 9 is adjusted to thereby control the air volume supplied to the inside of the room from the supply opening 10 of the duct. When the processing of step 609 is finished, the program returns to step 600, and then each step in FIG. 10 is executed in sequence.

Figure 11:
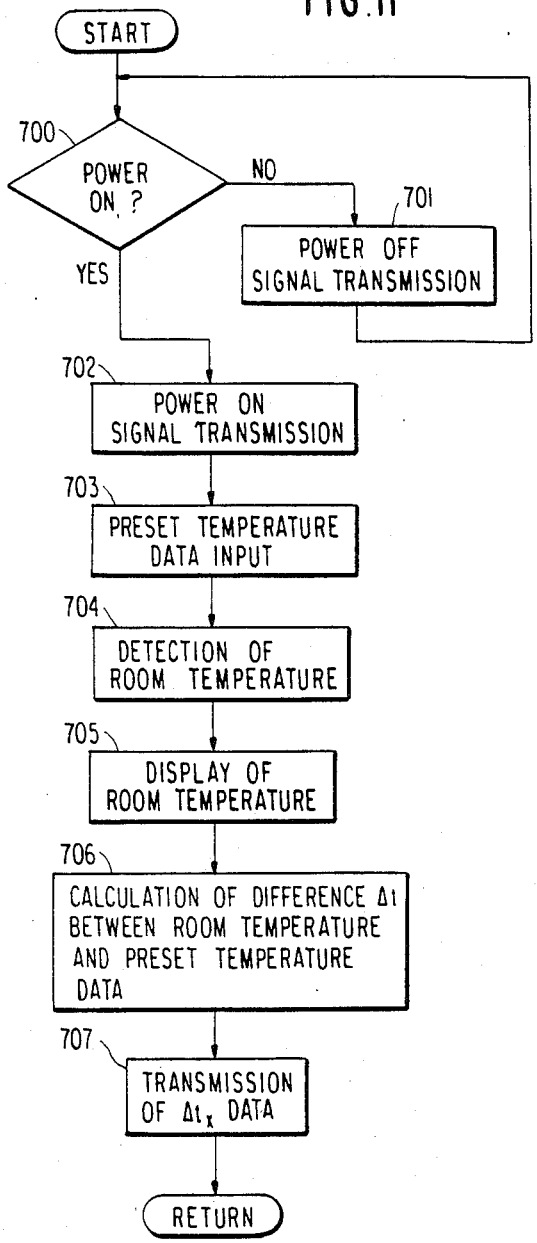

FIG. 11 is a flowchart showing the operation of the room controllers 14. When the program is started by initializing a room controller 14, step 700 decides whether the room is to be air conditioned on the basis of whether an "on" signal of the room is present or not. If the result is "NO", in step 701 an "off" signal is transmitted to the VAV control unit 104. Conversely, if it is "YES", an "on" signal indicating that a room to be air conditioned is selected is transmitted to the VAV control unit 104 in step 702. Then, in step 703, a room temperature value set in the manipulating section 405 is inputted to the microprocessor 401, and in the next step 704 the actual room temperature detected by the sensor 402 is converted to a digital value by the A/D converter 403 and sent to the microprocessor. In step 705 the processing of the room temperature is executed and the result is displayed on the display 404. In step 706 the difference $\Delta t_x$ between the room temperature and the set value is calculated, and in the next step 707 the calculated difference data $\Delta t_x$ is transmitted to the VAV control unit 104 through the serial transmission circuit 14A and the transmission line 106. Thereafter the above operations are repeated, and the on signal and the difference data $\Delta t_x$ are transmitted to the VAV control unit 104.

The function of the embodiment described above may be summarized as follows. The VAV control unit 104 exists independently for calculating and processing the inputs including the information from the room controller 14 in each room required for the zoning VAV control, and including the static pressure data of the pressure sensor 16. This data is the basic data to ensure an air volume corresponding to a change in the static pressure within the main duct 6 depending on the degree of opening of the damper 9 of each room; the VAV control unit 104 controls the damper 9 in each room based on the aforementioned information.

Since the VAV control unit 104 is provided with the serial transmission circuit 104A, the microprocessor 210 within the VAV control unit combines the aforementioned information and transmits it to the indoor control device 101. In other words, the indoor control device 101 normally performs central and lump air conditioning, but when it is determined that the data link between the VAV control unit 104 and the indoor control device 101 has been automatically established and the VAV control unit has been connected, the indoor control device 101 controls the rotational speed of the indoor blower 5 and the rotational speed of the outdoor compressor 17B.

Further, the transmission line 106 connecting the indoor control device 101, the VAV control unit 104, and the room controller 14 in each room is used in common with the electric power supply line to these members, and the establishment of the data link between the indoor control device 101 and the VAV control unit 104, and between the VAV control unit and each room controller 14 is attained by a communication technique using the polling method. As a result the combination of the central and lump air conditioning and the zoning control can be made at will, and the control of these two types of air conditioning is performed to meet an increase and a decrease in the number of the rooms.

Accordingly, in the embodiments described above, the following advantageous effects are obtained:

(a) Users can purchase a central and lump air conditioning type of inexpensive unit at first, and later modify it to a VAV system which saves energy and provides greater comfort conditions.

(b) The cost burden imposed on the users who purchased a central and lump air conditioning unit initially and wish to modify to a VAV system does not increase very much since it is only necessary to add the minimum software required for VAV control. Thus it is possible to provide a very marketable air conditioning system.

(c) When the VAV control unit is to be installed, it is only necessary to wire a communication transmission route consisting of two wires, and thus the installation work is simple, and the additional cost in modifying to the VAV system is low.

(d) Even when the number of rooms is increased after an air conditioning system has been purchased, the countermeasure to this is very simple. That is, by merely leaving some space beforehand in the address part allocated for the discrimination, and also by providing spares for the wirings of the damper motors, it is possible to accommodate an increase in the number of rooms.

(e) The transmission of the room number data and control data required at the time of the VAV control operation is carried out from the room controller 14 to the VAV control unit 104, and to the indoor control device, and further to the outdoor machine 17 by the program processing. Hence, the reliability in the control of the operation of the air conditioning equipment can be improved.

Figure 12:
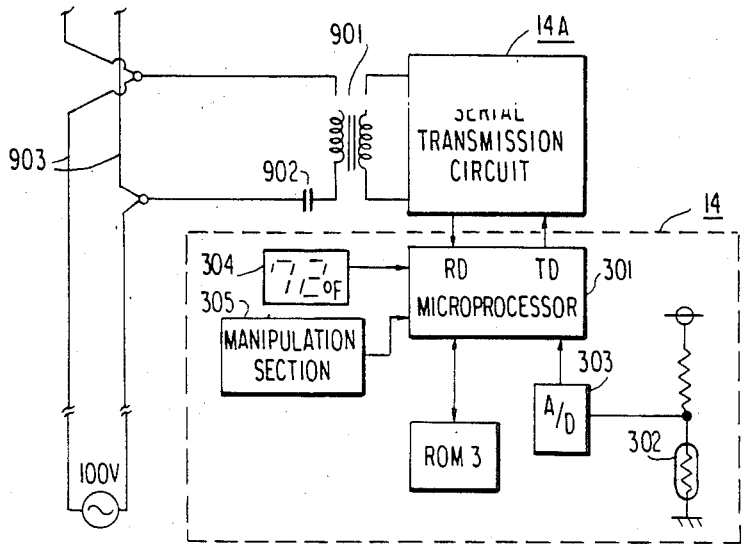
FIGS. 12 and 13 are circuit diagrams showing a transmission route and a control section connected to the transmission route in other embodiments of the invention.

FIG. 12 shows an example of the case in which commercial power distribution lines are utilized as the transmission line 106 for the connection with the room controller 14. More particularly, the serial transmission circuit 14A of the room controller 14 is connected to a commercial power distribution line 903 through a coupling transformer 901 and a DC blocking capacitor 902. Accordingly, the transmission line need not be provided separately, and the installation of the room controller is simple.

Figure 13:
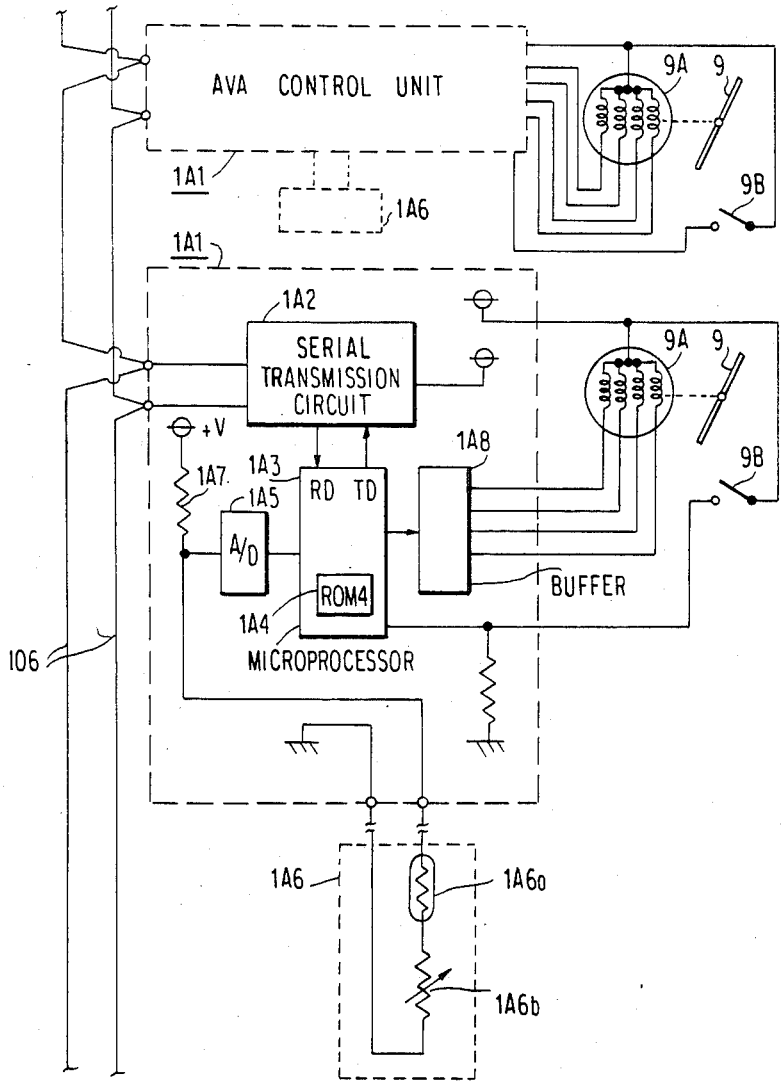

FIG. 13 shows a further embodiment in which the idea shown in FIG. 12 is further developed. In this Figure, a plurality of new VAV control units 1A1 are connected to common transmission line(s) 106. Each of the VAV control units 1A1 includes a serial transmission circuit 1A2 which transmits the VAV information through the transmission line 106. A microprocessor 1A3 connected to the serial transmission circuit includes a program memory 1A4. An A/D converter 1A5 is connected to the microprocessor, and an input terminal of the converter is grounded through a room sensor 1A6 consisting of series circuit of a thermistor **1A6*a* for detecting the air temperature of the room and a room temperature setting variable resistor 1A6*b*. The input terminal is also connected to a power supply +V through a fixed resistor 1A7. With this arrangement the difference $\Delta t_x$ between the room temperature and the set value is detected, and this difference is outputted to a buffer 1A8 to step the damper motor 9A to thereby adjust its degree of opening. The position of the damper 9 is detected by the position sensor 9B and fed back to the microprocessor 1A3**.

Accordingly, when this arrangement is employed, it is possible to install the VAV control unit 1A1 in the vicinity of the damper 9 in each room, and the room sensor 1A6 can be installed in the room in place of the room controller 14. In this case, if desired, the calculation of an integrated mean value of $\Delta t_x$ in the VAV control unit 1A1 of each room may be performed in the indoor control device 101, and also the capacity of the indoor blower 5 or the heat source of the outdoor machine 17 may be controlled according to the integrated mean value together with other information.

Further, by storing the program required for VAV control in the indoor control device 101 beforehand, it is possible to add a VAV control unit 1A1 to each room one by one to attain a VAV system. For example, when a central and lump air conditioning system was installed at the time a house was newly built, and after several years the house is extended, by purchasing and adding the VAV control units 1A1 and the room sensors 1A6, it is possible to achieve comfortable and energy saving air conditioning for individual rooms.

The heat source device or machine 17 may comprise a heat pump, a gas furnace, an air conditioner, or an electric heater, or a combination of such components.

What is claimed is:

1. A duct type air conditioning system for performing air conditioning by distributing temperature adjusted air to a plurality of rooms through an air duct, comprising:

(a) an indoor control device for performing lump and simultaneous air conditioning of said rooms;

(b) a plurality of room controllers adapted to be added as options to said indoor control device after the installation thereof for individually setting and detecting the temperature of each room; and (c) a variable air volume (VAV) control unit selectively connected to said indoor control device after the installation thereof for transmitting temperature information and room information from said room controllers to said indoor control device, and for adjusting the degree of opening of a damper provided at an air distributing end of the duct of each room in accordance with said temperature information and said room information, wherein information transmission between said indoor control device and said VAV control unit, and between said VAV control unit and said room controllers, is carried out by digital transmission circuits, and wherein signals transmitted by said transmission circuits comprise serial bit signals and include identification signals for establishing data links between control devices communicating with each other, each of said identification signals including self address signals representing the control device sending the serial bit signals, and including opponent address signals representing the control device receiving the serial bit signals.

2. A system according to claim 1, wherein a common transmission line connects said transmission circuits of said indoor control device, said variable control unit, and said room controllers.

3. A system according to claim 2, wherein said transmission line also serves as an electric power distribution line.

4. A system according to claim 2, wherein said transmission line comprises a commercial electric power distribution line extending through the inside and outside of a house.

5. A system according to claim 1, wherein each room controller is provided with means for setting heating load information.

6. A system according to claim 1, wherein said indoor control device is adapted to control the capability of a blower and a heat source unit based on room information and the temperature information transmitted from said VAV control unit.

* * * * *